United States Patent [19]

Lems et al.

[11] Patent Number: 4,848,064

[45] Date of Patent: Jul. 18, 1989

[54] ZIPPER BAG FILLING MACHINE AND METHOD

[75] Inventors: Peter Lems, Wilmette, Ill.; Steven Ausnit, New York, N.Y.; Robert S. Nocek, Stamford, Conn.; Thomas Scanlon, San Antonio, Tex.

[73] Assignee: Minigrip, Inc., Orangeburg, N.Y.

[21] Appl. No.: 161,380

[22] Filed: Feb. 19, 1988

Related U.S. Application Data

[63] Continuation of Ser. No. 874,447, Jun. 16, 1986, abandoned, which is a continuation-in-part of Ser. No. 746,079, Jun. 18, 1985, Pat. No. 4,665,552.

[51] Int. Cl.[4] ..... B65B 9/13; B65B 43/26; B65B 7/02

[52] U.S. Cl. ..... 53/459; 53/384; 53/468; 53/469; 53/570

[58] Field of Search ..... 53/377, 382, 384, 550, 53/457, 459, 468, 469, 476, 570

[56] References Cited

U.S. PATENT DOCUMENTS

| | | | |
|---|---|---|---|
| 3,599,388 | 8/1971 | Feingold | 53/459 X |
| 3,618,286 | 11/1971 | Membrino | 53/459 |
| 3,699,746 | 10/1972 | Titchenal et al. | 53/384 X |
| 3,744,211 | 7/1973 | Titchenal et al. | 53/384 X |
| 4,021,283 | 5/1977 | Weikert | 53/469 X |
| 4,514,962 | 5/1985 | Ausnit | 53/384 X |
| 4,517,788 | 5/1985 | Scheffers | 53/570 X |
| 4,522,017 | 6/1985 | Scheffers | 53/468 X |
| 4,534,158 | 8/1985 | McClosky | 53/570 X |

FOREIGN PATENT DOCUMENTS

| | | | |
|---|---|---|---|
| 2068880 | 9/1981 | United Kingdom | 53/570 |

*Primary Examiner*—Robert L. Spruill
*Assistant Examiner*—Beth Bianca
*Attorney, Agent, or Firm*—Hill, Van Santen, Steadman & Simpson

[57] ABSTRACT

A system for seriatim filling and separating zipper-equipped bags supplied in a chain has a filling station in which each bag mouth is spread open to permit top filling, a closing station in which the zipper profiles of each filled bag are interlocked, and a separation station in which the filled bag is separated from the chain. A pincer action grasps each filled bag, draws the filled bag through the closing and separation stations, and releases the separated and filled bag for collection. The operation of the pincer serves to bring about indexing of the bags in the chain through the bag filling system. The result is an economical and reliable zipper equipped bag filling method and apparatus.

26 Claims, 5 Drawing Sheets

A
B
C
D
II
10
11
12
12A
13
14
15
16
16a
17
20
21
22
26
27
27A
28
45
50
51
52
54
55
56
58
59
60
61
62
70
71
72
74
75
76
77
78
80
81
82
83
84
85
86

ZIPPER BAG FILLING MACHINE AND METHOD

CROSS-REFERENCE TO RELATED APPLICATIONS

This application is a continuation of Ser. No. 874,447, filed June 16, 1986, now abandoned which was a continuation-in-part of Ser. No. 746,079, filed June 18, 1985 now U.S. Pat. No. 4,665,552.

BACKGROUND OF THE INVENTION

The invention relates to a system by which a chain of interconnected reclosable plastic bags equipped with interlocking fastener strip rib and groove profiles ("zippers") are individually opened, filled, closed, and separated from the chain for packaging.

A zipper lock plastic bag of the type described, for example, in U.S. Pat. No. 3,198,228 has closed bottom and side edges and a reclosable upper end mouth with interlocking fastener strip rib and groove profiles running across inner facing surfaces of the mouth. The nature of manufacture and operation of the reclosable plastic bags presents altogether different handling problems than those presented by bags arranged for heat seal closing. For instance, reclosable zipper lock bags are typically closed at their mouth ends during the manufacture process in order to allow for proper interfitting of the rib and groove members and exit the manufacturing site in that closed condition. The bag mouths must be opened at a loading site to permit filling and then closed again for packaging.

In recent times, an automated machine was devised, as disclosed, for example, in U.S. Pat. No. 4,490,959, for transporting, opening, filling, closing, and separately discharging reclosable zipper lock plastic bags sequentially one at a time in a fully automated manner. The bags passed through the machine are interconnected with one another in a chain. While this machine is ideal for users having relatively high production packaging requirements, there is still a need for a more economical zipper bag filling machine which is reliable and convenient, but which better suits the cost expectations and demands of relatively smaller or speciality packagers with low or intermittent production.

The present invention concerns a method and means for filling zipper lock plastic bags which directly satisfies the cost, production, and operational requirements of the low or intermittent production packager and affords reliability and convenience, making rapid filling of zipper lock plastic bags readily available to this type of packager.

SUMMARY OF THE INVENTION

A system, which can be manually operated, such as by hand or a foot treadle lever, or automated, serves to open (for filling), close and separately discharge reclosable zipper lock plastic bags sequentially one at a time as the bags are conducted through the system laterally connected together with one another in a chain. The bags are top fillable and of a construction wherein each bag has closed bottom and side edges and reclosable zipper profiles extending across the top of each bag with upstanding front and rear pull flanges extending above the zipper profiles. The bags are partially separated by separations closing their adjacent sides, the separations extending upwardly past the zipper profiles to the tops of the pull flanges. Respective continuous strips integrally connect the tops of the front and rear pull flanges of all of the bags and thereby connect the bags in continuous series in a chain. The connecting strips have interior-facing (or exterior-facing) guide ribs extending continuously along their upper edge portions such that the bags can be slideably drawn through the system on guide rail supports. The strips are removable from the tops of the pull flanges so that the bags become separated from one another after being filled.

The bags may enter the system with their mouth ends closed in the fashion they typically leave manufacture. Each bag is initially supported in a filling station between a pair of laterally directed arms substantially coaxial with the zipper profiles and guide ribs of the bags in the chain. Each arm has a guide rail for receiving thereacross the guide rib of one connecting strip such that the bag is supported on the arm; and each arm has a self-adjusting paddle which descends into the space between the respective pull flanges of the bag. The arms pivotally spread apart, causing the paddles to engage the front and rear surfaces of the bag pull flanges, to open the bag mouth for filling. With the bag filled, the arms return together and the filled bag is conducted from the filling station to a closing station where a pair of closing blocks having a vertical row of lateral grooves on their opposing faces join the zipper profiles back together in locked engagement. The closed bag passes through a separating station where a knife edge extends transversely across the lateral movement path of the bag to sever the continuous strip from the pull flanges as the bag passes from the closing station. By this arrangement, the bags of the chain are consistently indexed to common points in the system for filling and separation from the remainder of the bag chain.

Each bag is individually grasped between a pair of grip jaws in the filling station. The grip jaws are part of a pincer which is disposed for pivotal movement toward and away from the filling station. The pincer movement also powers the spreading and closing of the arms in the bag filling station. The grip jaws release each filled, closed, and severed bag away from the filling station and are then returned to the filling station for a repeat of the process.

The movement of the pincer serves to conduct the bags of the chain through the system, as well as transport each separated, closed, and filled bag to a suitable collection area away from the filling station. The pincer can be suitably automated or manually operated or, in a possible alternately simpler version of the described device, eliminated such that the bags are pulled through the system by hand with the operator's fingers gripping the free end of the pull flanges of the filled bag.

Further embodiments and functions of the invention are disclosed in the drawings and detailed description described hereafter.

DESCRIPTION OF THE PREFERRED EMBODIMENT

The present invention is directed to a packaging system particularly adapted for loading reclosable zipper lock plastic bags initially arranged in a bag chain. Each bag is characterized by closed bottom and side edges and a reclosable upper end mouth having a pair of cooperatively interlocking fastener strip profiles formed with respective engageable rib and groove elements.

Figures 1, 2, 3:
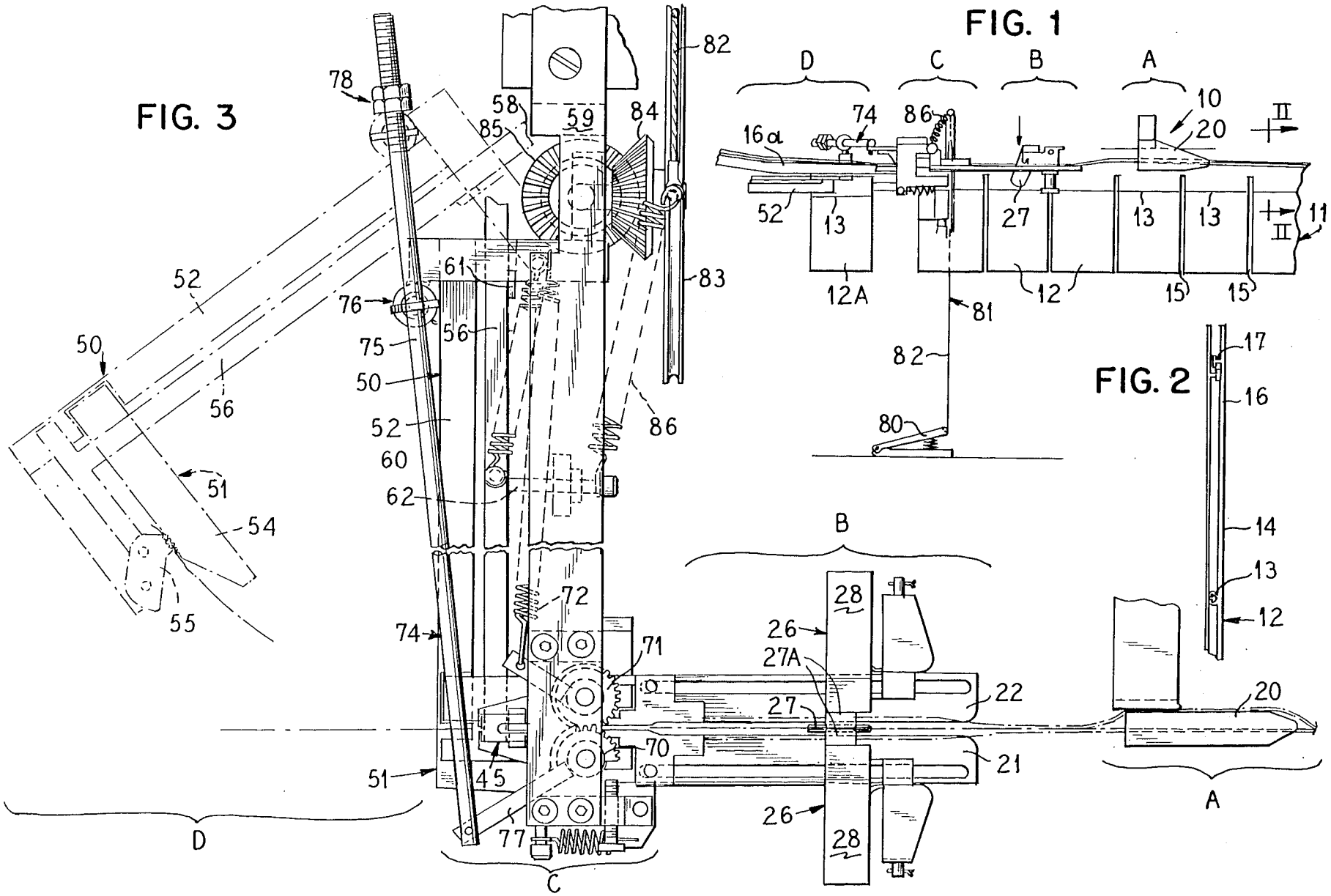
FIG. 1 is a side elevational view of the inventive bag filling system.
FIG. 2 is a cross-sectional view taken along lines II—II of FIG. 1.
FIG. 3 is a plan elevational view of the inventive bag filling system of FIG. 1, showing movement of the pincer means.

FIG. 1 serves to generally illustrate the inventive bag filling system 10 in which zipper lock bags 12, arranged in a chain 11, pass laterally from right to left as shown in FIG. 1 sequentially through a series of operations.

Each bag is formed with a laterally directed zipper 13 (comprising the reclosable interlocking rib and groove profile strips) extending between the opposed side edges of the bag and defining a top fillable bag mouth. Upstanding from the profile strips of the zipper 13 are front and rear pull flanges 14. The bags are partially separated from one another in the chain 11 by separation spaces 15, the separations 15 extending upwardly past the zipper 13 and to tops of the pull flanges 14. With particular reference to FIG. 2, respective continuous strips 16 integrally connect the tops of the front and rear pull flanges 14 of all of the bags in the chain and thereby serve to connect the bags in continuous series. The connecting strips 16 have guide ribs 17 extending laterally continuously along their upper edge portions, serving as support rails so that the connected bags can be slidably drawn through the system 10. Removal of the strips 16 from the tops of the pull flanges results in the bags being separated from one another by virtue of the separations 15. In the preferred arrangement, the side edges of the pull flanges 14 for each bag are secured together at the separations 15, and the secured pull flange edges remaining secured after removal of the strips 16. The bags 12 are vertically draped and the chain 11 is disposed for advancement laterally from right to left as shown in FIG. 1 through the system 10. The system 10 is adapted to handle the bags 12 with their zippers closed, which is the typical disposition of the bags following manufacture.

The system 10, as shown in FIG. 1, may be broken down into multiple regions of operation which sequentially act upon the bags in the chain 11. At region A, there is provided a stationary guide track element in the form of an upwardly sloped plow 20 having a laterally directed channel therethrough for preferably receiving only one of the guide ribs 17 therealong while the other guide rib and its connecting strip pass along the outside of the plow. The plow 20 serves to support and align the bag chain for entry into the bag filling and separating mechanism and straighten out any bags of the chain that may be flipped over such that all bags entering the mechanism are in a proper vertically draped disposition with their bag mouths facing upward.

Region B defines a filling station in which each bag of the chain stops and is regularly aligned. At the filling station, the pull flanges 14 of the bag are adapted to be engaged and firmly opened apart in a direction transverse to the lateral movement of advancement of the bags through the system 10 for effecting opening of the zipper 13 of the bag, such that the bag may be filled. After filling, the pull flanges of the bag are drawn back together in the filling station, the bags being supported in the filling station on guide track means respectively engaging with the guide ribs 17 of the bag. The filled bag is then advanced to region C at which the zipper profiles of the bag are pressed back together so as to be in interlocking engagement and the continuous strip portion 16 of the bag is separated from the pull flange portion 14, such as with a knife edge. In region D, there operates a pincer means which moves between a first point located in region C and a second point substantially away from the filling station and serves to grasp each filled bag and draw the bag through the operations of the region C, the result of which is the filled bag is reclosed and separated from the upstream end of the bag chain 11. The pincer means moves the separated and filled bag fully away from the filling station to the second point at which its grasp on the bag is released. The particular mechanisms for operating the bag filling system 10 will now be described.

This pincer movement which controls the movement of the bags through the system can be automated. Alternately, the system can be simplified and the bags grasped and pulled through by a person's fingers.

Figure 4:
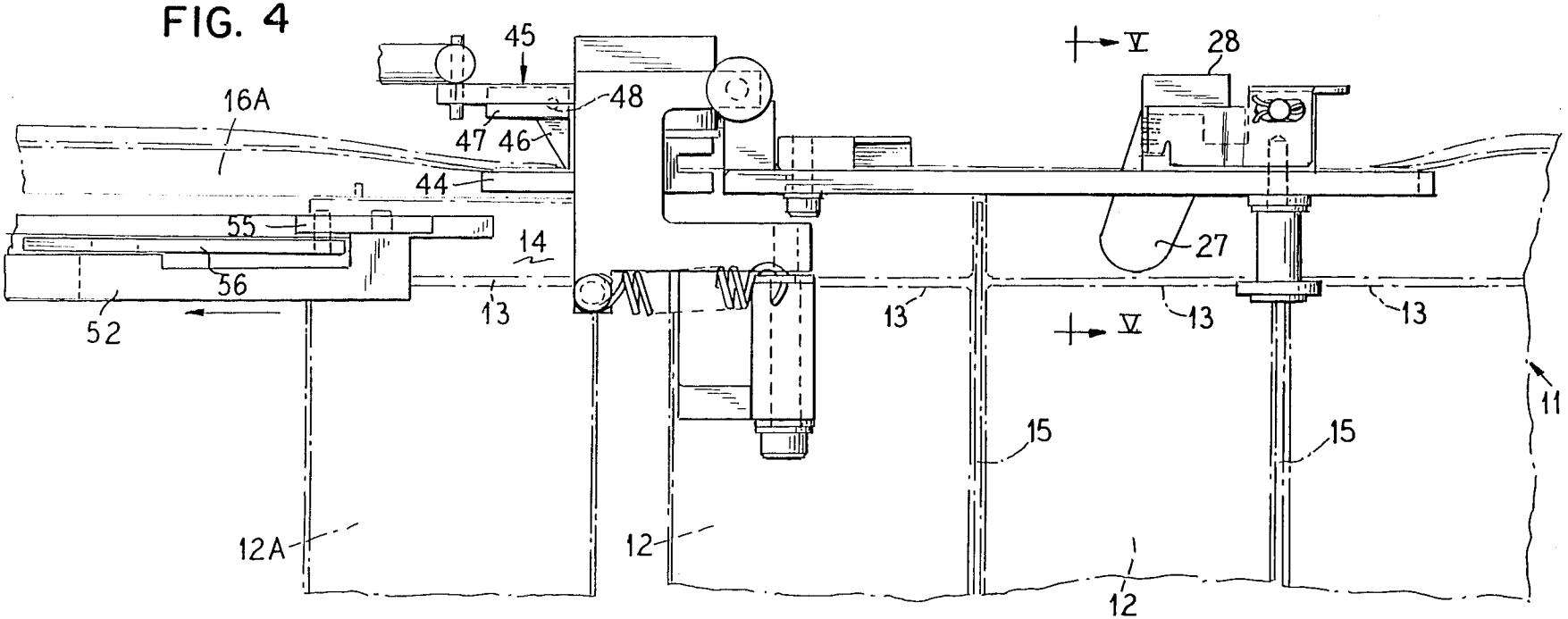
FIG. 4 is a side elevational view of the inventive bag filling system as a filled, closed, and separated bag is withdrawn from the filling station.
Figure 5:
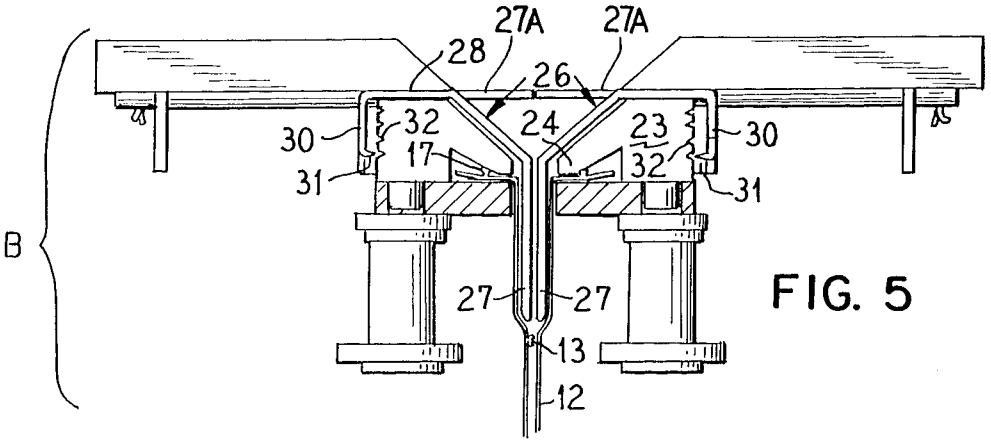
FIG. 5 is a cross-sectional view taken along lines V—V of FIG. 4.

With reference to FIGS. 3–6, the upper ends of the bags are received in the filling station from the guide track device 20 between a pair of jaws or arms 21 and 22. These arms are each supported for pivotal movement about vertical pins supporting their downstream ends. As supported, the jaws 21 and 22 are arcuately movable between a relatively closed position as shown in FIGS. 3–5 and an open position wherein the jaws are spread apart to diverge from one another (the opening movement of the jaws being shown underway in FIG. 6). Each jaw comprises a platform surface on which is suitably disposed a guide structure 23 having a lip end 24 overhanging the platform and defining therebetween a separation space to serve as a track groove for slidably receiving the upper end of the continuous strip 16 of the bags such that the respective guide ribs 17 are held within the track groove for vertical grasping support of the bags in the filling station. On each platform, there is provided a bag pull flange gripper means 26 having a vertically downwardly extending paddle portion 27 for engaging the inner surface of a respective bag pull flange.

The paddle 27 is connected to a bracket 28 which is disposed for free pivotal movement about a transversely extending bar 29 mounted on the platform. The bracket 28 is loosely supported for a lost-motion effect on the bar 29, and is formed with a downwardly extending flange 30 on the other side of the bracket form the paddle 27. With particular reference to FIG. 5, the flange 30 has an inwardly directed tooth 31 formed at its lower end for selectively engaging in any one of a vertical row of laterally directed tooth grooves 32 formed on the back wall of the platform's guide structure 23. The guide structures 23 are adjustably fixed by suitable means in channels 25 along the platforms of jaws 21 and 22 so that their relative position can be optimized for any specific size bag to be opened and filled.

The paddles 27 of the filling station jaws are disposed between the continuous strips 16 of each bag as it enters the filling station, at which time the jaws 21 and 22 are in their relatively closed disposition as shown, for example, in FIGS. 3 and 5. In order to assure smooth operation of the pull flange gripper means 26 the paddles 27 are kept slightly apart, thus avoiding contact friction between them, by virtue of spacer ribs 27A respectively disposed on the brackets 28 and extending inwardly thereof to abut one another. These ribs maintain spacing between the paddles and, when abutting one another, maintain the associated teeth and grooves 31 and 32 spaced clear of one another. In this closed position of the jaws, the loose disposition of the brackets 28 and the spaced clear disposition of the teeth and grooves 31 and 32 enable the paddles 27 to drop freely downward between the pull flanges of the bag, abutting on top of the closed zipper 13. When the filling station jaws 21, 22 open in preparation for filling, the bag surfaces tug the paddles slightly in the transversely inward direction, whereby the bracket teeth 31 engages in appropriate tooth grooves 32 locking the paddles 27 against possible rotational movement up and out from between the pull flanges. In this manner, the paddles 27 serve to clamp the pull flanges of the bag such that the jaws 21 and 22, in opening, can pull the flanges 14 apart and thereby separate the closable zipper of each bag at the filling station. The vertical array of tooth grooves 32 for selective operation with the bracket tooth 31 serves as a self-adjusting locking device on the disposition of the paddles 27 which allows for possible manufacturing variations in the depth from the top of the bags at which the zipper 13 is situated. When the jaws 21 and 22 are expanded, the pull flanges 16 and zipper profiles 13 of the bag in the filling station are forcibly spread apart and the bag mouth is opened for top filling.

After the zipper of the bag in the filling station has been separated and the bag filled through the now open bag mouth, the jaws 21 and 22 are returned to the closed position. However, at this point the cooperating zipper profiles are not re-engaged and, in this disposition, the filled bag is indexed laterally forward into region C.

To perform their functions, the paddles 27 need to rest on or near the zipper profiles. During the transfer of the bag chain, however, the paddles are pushed by weld spots closing together the ends of the zipper profiles of each bag. Thus, the paddles 27 need to be freely pivotable (about bars 29) to allow for movement of the weld spots thereunder, as well as to freely adjust for differences among bags in vertical height between zipper profiles and the tops of the pull flanges. Nevertheless, it is also necessary to prevent the paddles 27 from being free to pivot laterally out of the bag mouth during the bag opening phase. Thus, the selective locking action of the teeth 31 and grooves 32 cause the paddles 27 to be held against rotational movement for opening of the bag mouth and zipper profiles to permit filling. The loose, lost-motion disposition of the paddle brackets 28 on bars 29 enable the paddles to shift between the phases when the paddles 27 must be freely pivotable and when the paddles must be locked to grip the bag surfaces during spreading apart of the jaws 21 and 22.

Figure 7:
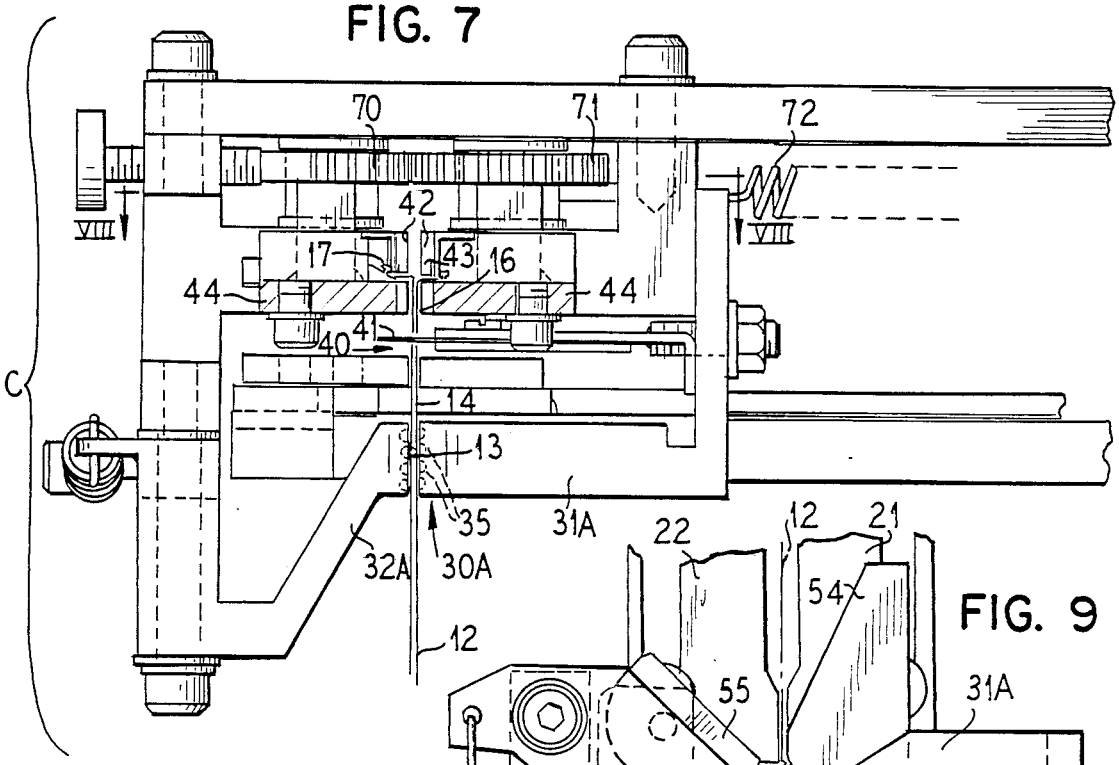
FIG. 7 is a transverse cross-sectional view of the inventive bag filling system looking downstream from the filling station.
Figure 10:
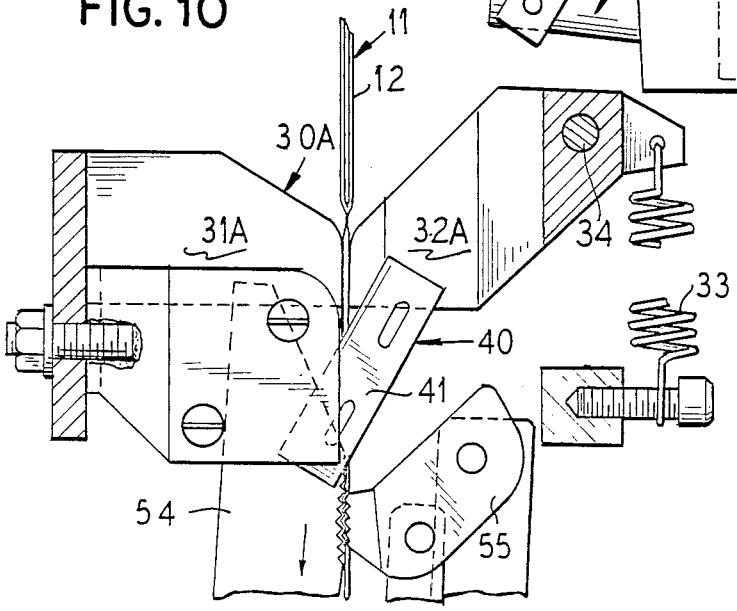
FIG. 10 is a partial plan elevational view of the portion of the inventive bag filling system downstream of the filling station on the grip jaws of the pincer means drawing a filled bag through the closing blocks and past the knife edge.

In region C, there is provided a closing station means 30A and a separating station means 40. With reference to FIGS. 7 and 10, the closing station means 30A serves to force back together the zipper profiles of the filled bag into closed interlock by utilizing a pair of transversely facing surfaces 31A and 32A between which the zipper portion 13 of the filled bag is passed. One of the facing surfaces 32A may be resiliently biased by a spring connection 33 about a pivot pin 34, as shown in FIG. 10, to effect a transverse pressure on the zipper passing between the closing station surfaces 31A and 32A, supporting the filled bag as well as effecting closing together of the zipper profiles. The zipper profiles are engaged in transversely opposed laterally running grooves 35 formed on the facing surfaces 31A and 32A. Each groove 35 is capable of fitting the respective zipper profile. There are a plurality of grooves 35 on each facing surface disposed in a vertical row, so that this arrangement of grooves 35 accommodates manufacturing dimensional variations in the relative vertical disposition of the zipper 13 among the bags in the chain 11, or between different size zipper bag chains.

Figure 10A:
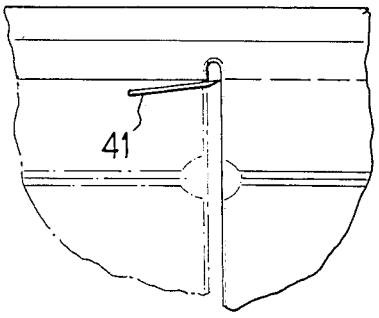
FIG. 10A is a schematic side-elevational view of the knife edge cutting angle relative to the bags.

Disposed above and just downstream of the closing station means 30A is a knife edge 41 which serves as the separation station means 40. The knife edge 41 extends transversely across the advancement path of the filled bag as shown in FIG. 10, and is mounted with a slight vertically upward rake as shown schematically in FIG. 10A to instill a downward force on the bag as it is cut. The knife edge engages each bag at the tops of the pull flanges 14 and just below the tops of the separations 15 for removing the continuous strips 16 from the bag. The filled bag is advanced past the knife edge 41 and in doing so passes into region D as an individual bag separated from the chain 11 as shown by bag 12A in FIG. 1.

The removed continuous strips are advanced out of region C into region D, as shown by separated strips 16A in FIGS. 1 and 4, due to the further advancement of the remainder of the chain 11. As shown in FIG. 7 the strips 16 are supported in region C for lateral movement above the filled bag being separated therefrom by virtue of guide track elements 42 having lip flanges 43 defining a gap thereacross from platform surfaces 44 into which the continuous strips 16 extend such that the guide ribs 17 slidably abut along the back surfaces of the lip flanges 43.

To prevent possible backward movement of the separated strips 16A being advanced from region C and to further support the strips, a free-pivoting stop device 45 shown in FIG. 4 overlies the platform surfaces 44 over which the strips pass downstream of the separating station means 40. The stop device 45 has a vertically downward directed tooth portion 46 for engaging strips 16A against the platform surfaces 44 and a counterweight block portion 47. The stop device pivots about a pin mounting 48. The tooth portion 46 is prevented from pivoting counterclockwise as shown in FIG. 4 past vertical since the tooth portion 46 is too long to clear the platform surface 44 in such a counterclockwise movement, and thus the tooth holds the strips 16A against the platform surface to prevent backward movement thereof.

Figure 9:
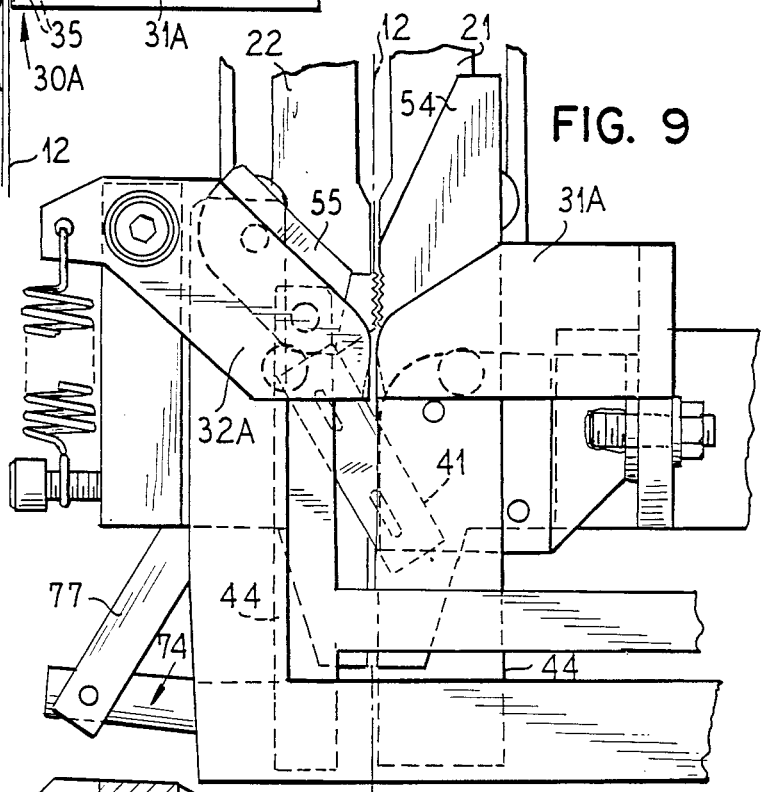
FIG. 9 is a partial plan elevational view of the portion of the inventive bag filling system downstream of the filling station when the grip jaws of the pincer means grip a filled bag.
Figure 12:
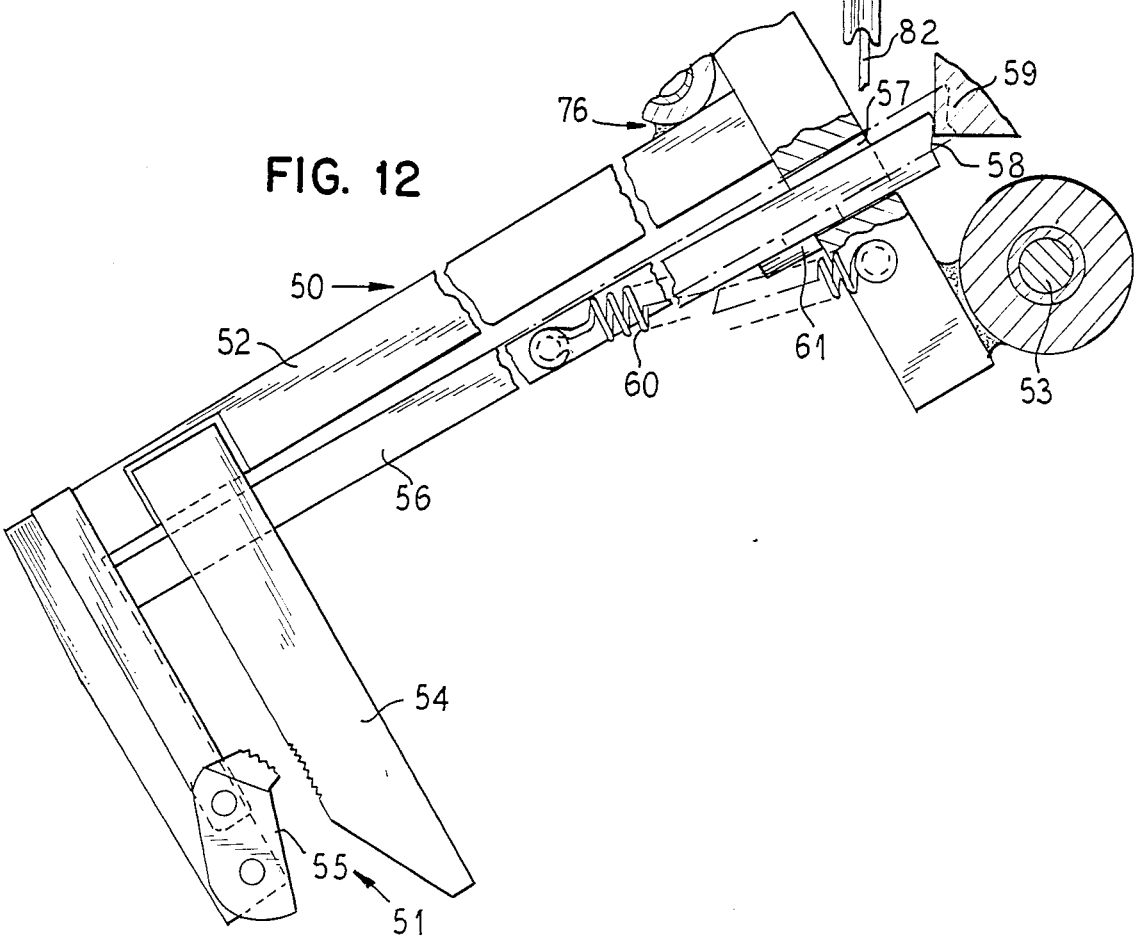
FIG. 12 is a partial cross-sectional plan elevational view of the pincer means when the grip jaws thereof are opened.

As shown in FIG. 3, pincer 50 advances the bags in the chain 11 and operates in regions C and D. The pincer 50 carries expandable jaw means 51 for grasping each filled bag in region C, as shown in FIG. 9, pulling the filled bag through the operations of region C, as shown in FIG. 10, and transporting the separated, individual bag fully away from regions B and C to where the jaw means open, as shown in FIG. 12, to release the bag. The pincer 50 is formed by an arm frame 52, at the free end of which the jaw means 51 is disposed and the other end of which is mounted for lateral rotation about a vertical pin 53, as shown in FIG. 12.

The jaw means 51 is arranged with a first grasping jaw 54 stationarily mounted on the arm frame 52 and a second cooperating grasping jaw 55 in the form of a toggle plate pinned at one end on the arm frame 52 and at the other end on the outer end of a link arm 56 loosely supported on the arm frame 52. As shown in FIG. 12, the opposed inner end of the link arm 56 projects through an opening 57 in the arm frame and is formed at the tip with a cam follower surface 58 which cooperates with a mounting wall edge 59 serving as a cam. The link arm 56 is biased inwardly on the arm frame 52 by a spring connection 60. A stop member 61 is formed on the link arm 56. The toggle-actuated jaw 55 closes onto the stationary jaw member 54 when the link arm 56 is relatively depressed through the opening 57 in the arm frame 52, with the recessed portion of the cam follower surface 58 on the link arm riding along the cam wall surface 59 and the stop 61 contained within the hollow of the opening 57. The cam follower surface 58 of the link arm is engaged against the cam wall surface 59 under the action of the spring 60. The toggle-actuated jaw 55 releases and spreads apart from the stationary jaw 54 when the relatively raised portion of the cam follower surface 58 on the link arm becomes engaged on the cam wall surface 59.

As shown in FIG. 12, the toggle-actuated jaw 55 is held in a spread-apart or open position relative to the other jaw 54 with continued movement of the relatively raised portion of the cam follower surface 58 over the cam wall 59 by virtue of the stop 61 being raised out of the opening 57 against the action of the spring 60 and lodging on the ledge surface of the arm frame 52 at the outer end of the opening 57. The toggle-actuated jaw 55 remains in the open configuration as shown in FIG. 12, by virtue of the engagement of the stop 61 on the ledge surface of the arm frame 52, until, referring to FIG. 3, the pincer 50 rotates back towards region C and the link arm 56 engages upon a projection 62 forcing the stop laterally back off the ledge of the arm frame 52 and, under the biasing action of the spring 60, into the opening 57.

The jaw 55 closes onto the stationary jaw 54 when the abutment 62 has engaged in the link arm 56. At this point, the grip jaw means 51 is disposed in region C, as shown in FIG. 9, the grip jaws 54 and 55 grasping the pull flanges 14 of the filled bag therebetween, illustrated in FIG. 7. The jaws 54 and 55 tightened on the pull flanges of the filled bag advance the filled bag therebetween, illustrated in FIG. 7. The jaws 54 and 55 tightened on the pull flanges of the filled bag advance the filled bag laterally through region C stations and, as long as the filled bag pull flanges continue to be connected with the continuous strips 16 as shown in FIG. 10, this advancing action of the filled bag causes laterally forwarding indexing of the remaining succeeding bags in the chain 11 through the system 10. After the arm frame of the pincer 50 has sufficiently advanced the filled bag through the stations of region C such that the filled bag becomes separated from the succeeding bags of the chain, the arm frame 52 continues its arc movement laterally away from its first point of disposition in region C shown in FIG. 9, with the grip jaws 55 and 54 continuing to grasp onto the filled bag as indicated by the dotted line portion of FIG. 3 until a second point of disposition of the arm frame 52 is reached, shown in FIG. 12, at which jaw 55 separates from jaw 54 and the grip on the filled bag is released such that the filled bag drops from the pincer 50 under gravity to a suitable collecting area.

Figure 6:
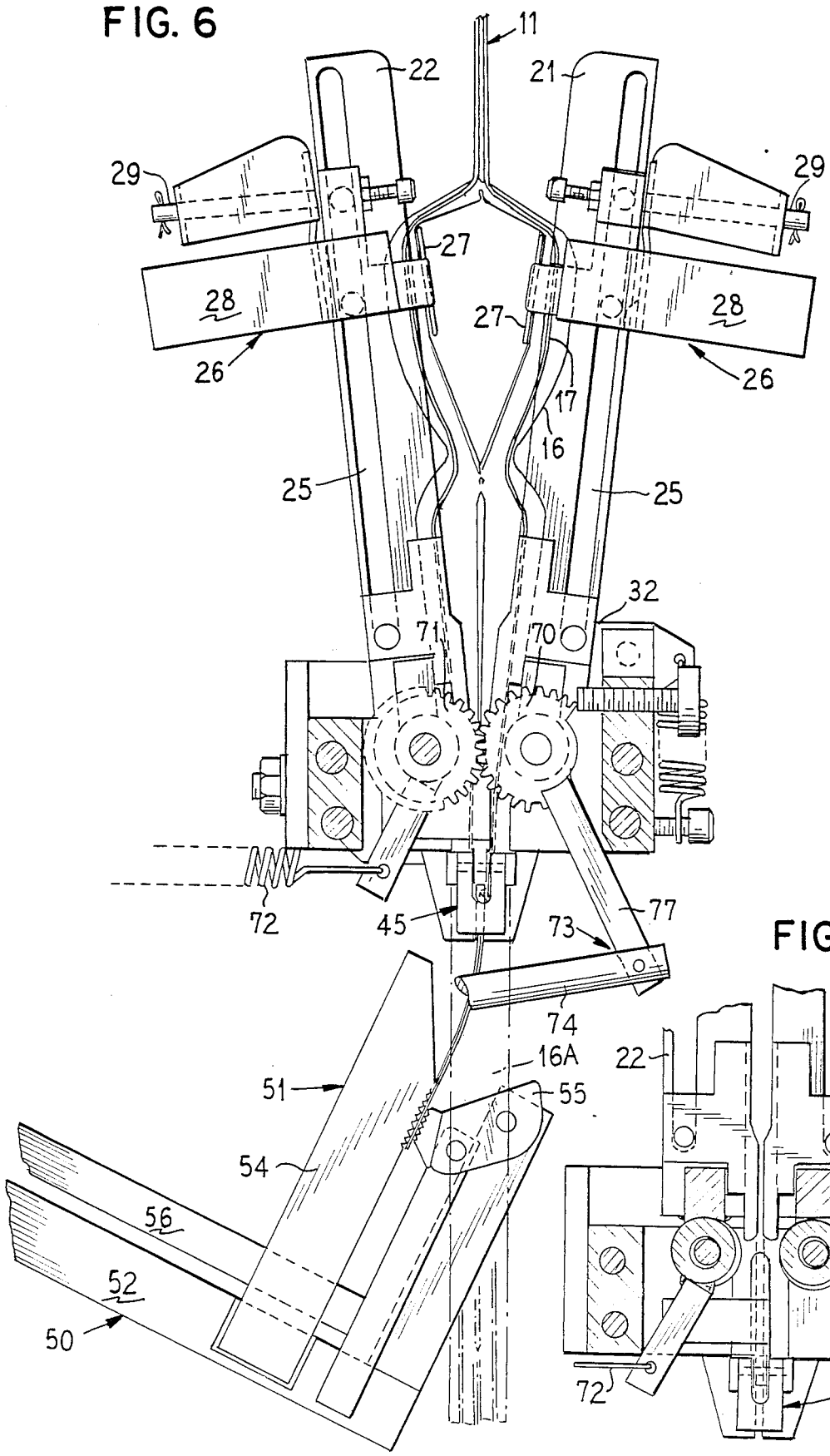
FIG. 6 is a plan cross-sectional view of the inventive bag filling system showing opening of the filling station jaws and a filled, closed, and severed bag being drawn from the filling station.
Figure 8:
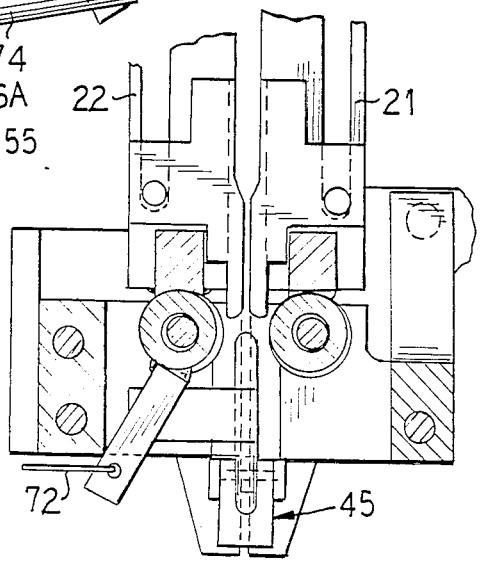
FIG. 8 is a cross-sectional view taken along the lines VIII—VIII of FIG. 7.

The opening and closing of the jaws 21 and 22 in the filling station of region B is effected by the rotation of a pair of interengaging gear wheels 70 and 71 respectively connected to the jaws 21 and 22 and rotatable about the vertical pin supports on which the jaws pivot. With reference to FIGS. 3, 6 and 8, one gear wheel 71 is biased by spring connection 72 for rotational movement drawing the filling station jaws 21 and 22 into their aligned, closed position illustrated in FIG. 3. The other gear wheel 70 is connected with a drive transmission linkage 73 which serves to rotate gear wheel 70 and gear wheel 71, against the force of the spring 72 to cause the filling station jaws 21 and 22 to spread apart, as shown in FIG. 6, leading to opening and filling of the bag in the filling station.

In accordance with the preferred embodiment, the drive transmission link means 73 is a lost-motion linkage wherein an elongated rod 74 has a free end 75 disposed for slidable movement through a support bracket 76 fixedly mounted on the pincer arm frame 52 adjacent a lower end thereof. The other end of the rod 74 is pin-connected to a link 77 which is fixed, such as by welding, to the gear wheel 70. An adjustable stop mechanism 78, in the form of a threaded double nut arrangement, is disposed along the outer length of the free end portion of the rod 74. The stop mechanism 78 serves to engage with rod support surfaces of the bracket 76 as the pincer 50 moves in region D carrying a separated and filled bag to its second point of disposition for releasing the filled bag. The degree to which the filling station jaws 21 and 22 spread apart may be varied, such as depending upon the size of the bag being filled, by linear adjustment of the stop mechanism 78 along the length of the rod 74.

Figure 11:
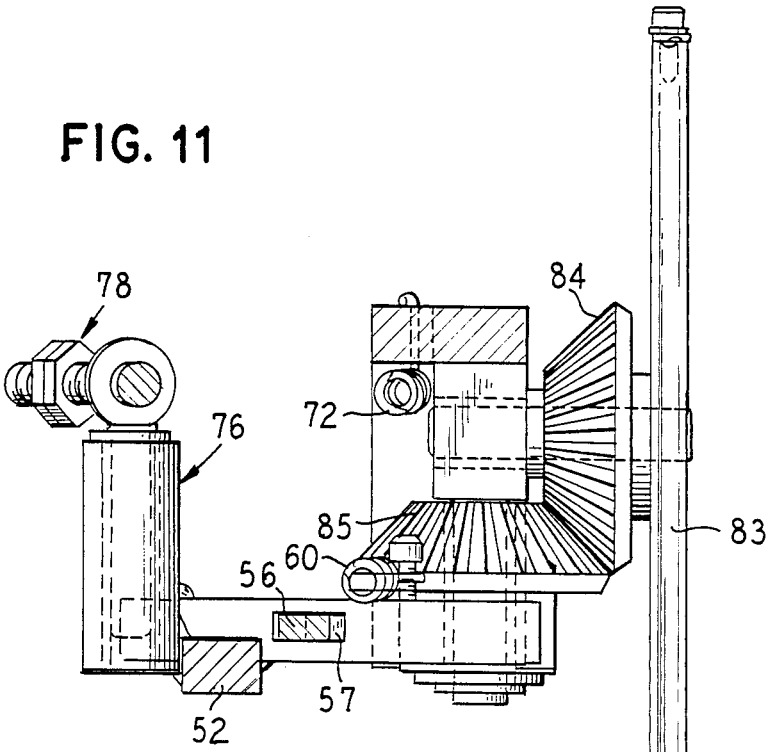
FIG. 11 is a partial side-elevational view of the drive transmission means.

In accordance with the preferred embodiment, the lateral arc movement of the arm frame of the pincer 50 in drawing a filled bag from region C fully into region D is powered by a foot treadle 80, operatively connected through a drive transmission means 81 to the arm frame 52, as indicated in FIG. 1. The drive transmission means 81, as illustrated in FIGS. 3 and 11, is such that depression of the foot treadle 80 tensions a wire 82 connected at its other end to a wheel 83 which operates a coaxial bevel gear 84, bringing about rotation of the wheel 83 and bevel gear 84. A pivotal lever arm may be used in place of the wheel 83. The bevel gear 84 engages with a bevel gear 85 fixedly connected to the arm frame 52 and rotatable about the vertical axis of the pin 53 about which the arm frame rotates. Thus, depression of the foot treadle 80 brings about rotation of the arm frame bevel gear 85 such that the pincer passes from right to left as shown in FIG. 3 through its arc of movement from its first point of disposition in region C to its second point of disposition in region D. The wheel 83 is biased by spring connection 86 for rotational movement contrary to depression of the foot treadle 80. Thus, when the foot treadle 80 is released, the bias of the spring connection 86 on the wheel 83 is effectively unopposed and the wheel 83 rotates driving arm frame bevel gear 85 in a counter-clockwise direction, as illustrated in FIG. 3, in turn driving the pincer 50 in its lateral arc movement from the second disposition point in region D back to the first disposition point in region C.

The bags 12 of the chain 11 are sequentially indexed through the system 10 one bag at a time each time the foot treadle 80 is depressed.

The above description, taken in conjunction with the accompanying drawings, represents the preferred embodiment of the inventive bag filling system. Variations and modifications may be effected without departing from the spirit and scope of the novel concepts embodied in the disclosure. For example, the pincer movement and operation could be disposed for hand operation by the user and the foot treadle power transmission connected directly to the filling station jaws for the opening and closing of the bags being filled.

We claim as our invention:

1. An apparatus for seriatim filling and separating bags supplied in a chain, wherein said bags have closed bottom and side edges and aligned tops closed by interlocking reclosable profiled zipper means from which a pair of pull flanges project upwardly, said bags being interconnected with one another in said chain by continuous connecting strips disposed above said pull flanges and said bags in said chain being separated from one another at their adjacent side edges by separations extending upwardly past said zipper means to the tape of said pull flanges, said apparatus comprising:

a filling station means having a pair of cooperating jaws defining a space therebetween and having means supporting said jaws for arcuate movement such that said jaws are movable between a closed position wherein said jaws are substantially parallel and an open position wherein said jaws are spread apart to diverge from one another, said jaws having strip retaining means for supporting said bag thereon by respective engagement of said strips, said bags being guided for movement and being supported when said bags are open for filling by said strip retaining means, a closing station means for interlocking said zipper means, a separation station means for removing said continuous strips from each said bag between said separations, and advancing means for grasping each said opened bag and drawing said opened bag operatively through said closing and separating station means such that said chain is indexed through said apparatus bag-by-bag to common point where a filled bag becomes separated from said chain.

2. The apparatus of claim 1, wherein said closing station means comprises a pair of surfaces between which said zipper means is passed, said surfaces each having a vertical row of grooves extending coaxial with said zipper means and each groove individually capable of fitting said respective zipper profile for accommodating variations in the relative vertical disposition of said zipper means on said bags.

3. The apparatus of claim 1, wherein said separating station means comprises a knife edge extending transversely across the path of advancement of said bags from said filling station means, said knife edge cutting said bags at a level beneath the tops of said pull flanges.

4. The apparatus of claim 1, wherein said strip retaining means are adjustably disposed along said jaws.

5. The apparatus of claim 1, wherein said filling station means includes paddles for projecting vertically between said strips and pull flanges of said bags and abutting close to said zipper means, said paddles mounted for lateral pivotal movement.

6. An apparatus for seriatim filling and separating bags supplied in a chain, wherein said bags have closed bottom and side edges and aligned tops closed by interlocking reclosable profiled zipper means from which a pair of pull flanges project upwardly, said bags being interconnected with one another in said chain by continuous connecting strips disposed above said pull flanges and said bags in said chain being separated from one another at their adjacent side edges by separations extending upwardly past said zipper means to the tops of said pull flanges, said apparatus comprising:

a filling station means having a pair of cooperating jaws having a space therebetween and movable between a closed position wherein said jaws are substantially parallel and an open position wherein said jaws are spread apart, said jaws having strip retaining means for supporting said bag thereon by respective engagement of said strips, said bags being guided for movement and being supported when said bags are open for filling by said strip retaining means;

a closing station means for interlocking said zipper means;

a separation station means for removing said continuous strips from each said bag between said separations;

advancing means for grasping each said opened bag and drawing said opened bag operatively through said closing and separating station means such that said chain is indexed through said apparatus bag-by-bag to a common point where a filled bag becomes separated from said chain said filling station means including paddles for projecting vertically between said strips and pull flanges of said bags and abutting close to said zipper means, said paddles mounted for lateral pivotal movement; and locking means associated with said paddles which set to prevent the pivotal movement of said paddles when said bag is being opened.

7. The apparatus of claim 6, wherein said locking means are set at variable pivotal dispositions of said paddles resulting from relative differences in vertical depth between the tops of said strips and said zipper means of said bags.

8. The apparatus of claim 1, wherein said advancing means grasps each said opened bag beneath the tops of the pull flanges of said bag.

9. The apparatus of claim 1, wherein said advancing means comprises a drive transmission means connected to said filling station means such that the drawing action of said advancing means activates the spreading apart action of said filling station means.

10. The apparatus of claim 9, wherein said advancing means is manually operated.

11. An apparatus for seriatim filling and separating bags supplied in a chain, wherein said bags have closed bottom and side edges and aligned tops closed by interlocking reclosable profiled zipper means from which a pair of pull flanges project upwardly, said bags being interconnected with one another in said chain by continuous connecting strips disposed above said pull flanges and said bags in said chain being separated from one another at their adjacent side edges by separations extending upwardly past said zipper means to the tops of said pull flanges, said apparatus comprising:

a filling station means having a pair of cooperating jaws having a space therebetween and movable between a closed position wherein said jaws are substantially parallel and an open position wherein said jaws are spread apart, said jaws having strip retaining means for supporting said bag thereon by respective engagement of said strips, said bags being guided for movement and being supported when said bags are open for filling by said strip retaining means;

a closing station means for interlocking said zipper means;

a separation station means for removing said continuous strips from each said bag between said separations;

advancing means for grasping each said opened bag and drawing said opened bag operatively through said closing and separating station means such that said chain is indexed through said apparatus bag-by-bag to a common point where a filled bag becomes separated from said chain said filling station means including paddles for projecting vertically between said strips and pull flanges of said bags and abutting close to said zipper means, said paddles mounted for lateral pivotal movement; and said advancing means comprising a pincer having expandable grip jaws at one end for grasping and releasing said bags and a pivot connection at the other end such that said pincer moves in an arc.

12. The apparatus of claim 11, wherein at least one said grip jaw is cam actuated to spread apart from said other grip jaw after said pincer has moved each said bag fully through said closing and separating station means and remain spread apart from said other grip jaw as said pincer moves back towards said successive opened bag on said chain until further cam actuated to close with said other grip jaw when said successive opened bag is between said grip jaws.

13. The apparatus of claim 11, wherein said pincer is moved in said arc about said pivot connection by action of a foot treadle and transmission means operatively connecting the action of said foot treadle to said pincer.

14. The apparatus of claim 1, further comprising means for preventing backward movement of said strips towards said filling station means after said strips have been removed from said bags.

15. In an apparatus for filling and separating serially connected top fillable bags one at a time laterally connected together in a chain, said bags having closed bottoms and side edges and reclosable zippers along their upper end portions with front and rear pull flanges extending above said zippers, said bags being separated from one another along their adjacent sides by separations which extend upwardly past said zippers and to the tops of said pull flanges, lateral continuous integral strips extending between the ends of said pull flanges connecting the tops of said bags above said pull flanges to one another, the upper ends of said continuous connecting strips having continuous guide ribs therealong, said apparatus comprising a bag filling station having supporting and separating jaw means for slidably engaging said ribs and separating said pull flanges and thereby said zipper of each bag for filling, and, downstream of said filling station, means for closing the zipper of said filled bag and means for separating said connecting strips from the tops of said pull flanges of said filled bag and thereby separating said filled bags from said chain, there further comprising for advancing said bags of said chain through said apparatus:

pincer means disposed at one end of an arm, the other end of which is connected to a mounting means enabling said one end of said arm to move between a first point adjacent said filling station and a second point spaced from said filling station, said pincer means having a pair of grip jaws, a link means for closing and opening said grip jaws, said link means having a cam follower surface for riding over a cam surface for maintaining said grip jaws open during movement of said arm from, and including, said second point up to said first point, for maintaining said grip jaws closing during movement of said arm from, and including, said first point up to said second point and for opening said grip jaws to release said filled bag, after being separated from said chain, at said second point.

16. The apparatus of claim 15, wherein said grip jaws grasp said filled bag by engaging said pull flange of said filled bag therebetween at a location vertically beneath the top of said strip.

17. The apparatus of claim 15, wherein said other end of said arm is mounted on a pivot such that said arm moves in an arc.

18. The apparatus of claim 15, wherein a lost-motion linkage means connected between said arm and said filling station jaw means causes said jaw means to effect separating of said pull flanges upon movement of said arm away from said first point.

19. The apparatus of claim 18, wherein said lost-motion linkage means is adjustable to vary the distance of separation of said pull flanges.

20. A method of seriatim filling of bags supplied in a chain, said bags have closed bottom and side edges and aligned tops closed by interlocking reclosable profiled zipper means from which a pair of pull flanges project upwardly, said bags being interconnected with one another in said chain by continuous connecting strips disposed above said pull flanges and said bags in said chain being separated from one another at their adjacent side edges by separations extending upwardly past said zipper means to the tops of said pull flanges, said method comprising:

passing said chain, with said bags vertically draped on support means, in a lateral path along which each said bag is opened at its zipper means for filling, each said filled bag thereafter has its zipper means interlockingly closed, and each said filled and closed bag has its respective strips severed from its respective pull flanges to separate said filled and closed bags from said chain, intermittently grasping each said filled bag on said chain prior to closing of said zipper means on said filled bag and pulling said filled bag through and beyond said lateral path to effect said passing and carry said filed, closed, and separated bag away from said chain, and powering the opening of each said bag zipper means via an adjustable lost-motion linkage means from said pulling whereby the degree of opening of each said bag zipper means for filling is variable.

21. The method of claim 20, wherein said pulling is manually effected.

22. For use in a device in which bags arranged in a chain laterally interconnected with one another are laterally conducted, each bag having a reclosable upper end mouth having interlocking fastener strip profiles running laterally across opposed inner facing surfaces of said mouth of said bag, apparatus for opening each bag mouth and separating said interlocking fastener strip profiles thereof comprising:

a pair of laterally extending arms disposed for pivotal movement of like ends thereof between a closed position defining a space therebetween into which each said bag is conducted and an open position in which said arm ends are spread apart transversely of the lateral conduct path of said bags, a pair of paddles respectively disposed on said arms for projecting vertically between said inner facing surfaces of said mouth and riding on said fastener strip profiles of each said bag, and an assembly for mounting each said paddle onto its respective arm enabling said paddle to freely pivot laterally when said arms are in the closed position and lock said paddle against said pivotal movement when said arms are spread apart to the open position.

23. The apparatus of claim 22, wherein said assembly comprises a pin on which said paddle laterally pivots and is disposed in lost-motion connection permitting back and forth movement of said paddle in the direction transverse of said lateral conduct path of said bags.

24. The apparatus of claim 22, wherein said assembly comprises a tooth and groove, one associated with said arm and the other with said paddle, transversely spaced clear of one another when said arm is in the closed position and becoming lockingly engaged when said arm is moved to the open position.

25. The apparatus of claim 24, wherein one of said tooth and groove is in a vertically stacked like array.

26. The apparatus of claim 22, wherein a pair of ribs respectively associated with said paddles extend transversely toward each other for abutting and transversely spacing said paddles when said arms are in the closed position.

* * * * *